US011873716B2

(12) United States Patent
Panda et al.

(10) Patent No.: US 11,873,716 B2
(45) Date of Patent: Jan. 16, 2024

(54) BINDER JETTING SYSTEM AND METHOD FOR PRODUCING ELECTROMAGNETIC PULSED POWER DRILLING COMPONENTS

(71) Applicant: Halliburton Energy Services, Inc., Houston, TX (US)

(72) Inventors: Krutibas Panda, Houston, TX (US); Philip Park Hung Leung, Houston, TX (US); Manoj Gangamwar, Houston, TX (US); Daniel Brendan Voglewede, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 129 days.

(21) Appl. No.: 17/538,215

(22) Filed: Nov. 30, 2021

(65) Prior Publication Data

US 2023/0167687 A1 Jun. 1, 2023

(51) Int. Cl.
*E21B 7/18* (2006.01)
*E21B 7/15* (2006.01)

(52) U.S. Cl.
CPC . *E21B 7/18* (2013.01); *E21B 7/15* (2013.01)

(58) Field of Classification Search
CPC ..... E21B 7/15; E21B 7/18; E21B 10/61
See application file for complete search history.

(56) References Cited

U.S. PATENT DOCUMENTS

| | | | | |
|---|---|---|---|---|
| 11,624,239 | B1 * | 4/2023 | Finke | E21B 10/00 175/16 |
| 2017/0072465 | A1 | 3/2017 | Welch et al. | |
| 2018/0209216 | A1 * | 7/2018 | Gilbrech | E21B 10/00 |
| 2018/0209217 | A1 * | 7/2018 | Moeny | H01G 4/224 |
| 2018/0313158 | A1 * | 11/2018 | Gilbrech | E21B 7/15 |
| 2018/0320449 | A1 | 11/2018 | Zhang et al. | |
| 2018/0347282 | A1 * | 12/2018 | Moeny | E21B 7/15 |
| 2019/0040685 | A1 * | 2/2019 | Moeny | E21B 10/00 |
| 2019/0323296 | A1 | 10/2019 | Gan et al. | |
| 2020/0063543 | A1 * | 2/2020 | Pai | E21B 7/15 |
| 2021/0079730 | A1 | 3/2021 | Moeny | |
| 2021/0310309 | A1 * | 10/2021 | Kronman | E21B 7/15 |
| 2021/0310310 | A1 | 10/2021 | Kronman | |
| 2021/0310311 | A1 * | 10/2021 | Kronman | E21B 7/15 |

OTHER PUBLICATIONS

Foreign Communication from Related Application—International Search Report and Written Opinion of the International Searching Authority, International Application No. PCT/US2022/045533, dated Jan. 26, 2023, 10 pages.

* cited by examiner

*Primary Examiner* — Frederick L Lagman
(74) *Attorney, Agent, or Firm* — Conley Rose, P.C.; Rodney B. Carroll

(57) ABSTRACT

A pulsed power drilling (PPD) component includes a functional gradient of material from a first portion to a second portion of the PPD component. The functional gradient of material provides a greater wear resistance of the first portion relative to the second portion and a greater electrical conductivity or resistivity of the second portion relative to the first portion.

21 Claims, 9 Drawing Sheets

BINDER JETTING SYSTEM AND METHOD FOR PRODUCING ELECTROMAGNETIC PULSED POWER DRILLING COMPONENTS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates generally to pulsed power drilling operations. More specifically, the present disclosure relates to pulsed power drilling system components having a functional gradient of material. Still more specifically, the present disclosure relates to pulsed power drilling components having a functional gradient of material produced via binder jetting.

BACKGROUND

Pulsed-power drilling utilizes pulsed power technology to drill a wellbore in a rock formation. Pulsed power technology repeatedly applies a high electric potential across electrodes of a pulsed-power drill bit, which ultimately causes the surrounding rock to fracture. The fractured rock is carried away from the bit by drilling fluid and the bit advances downhole.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
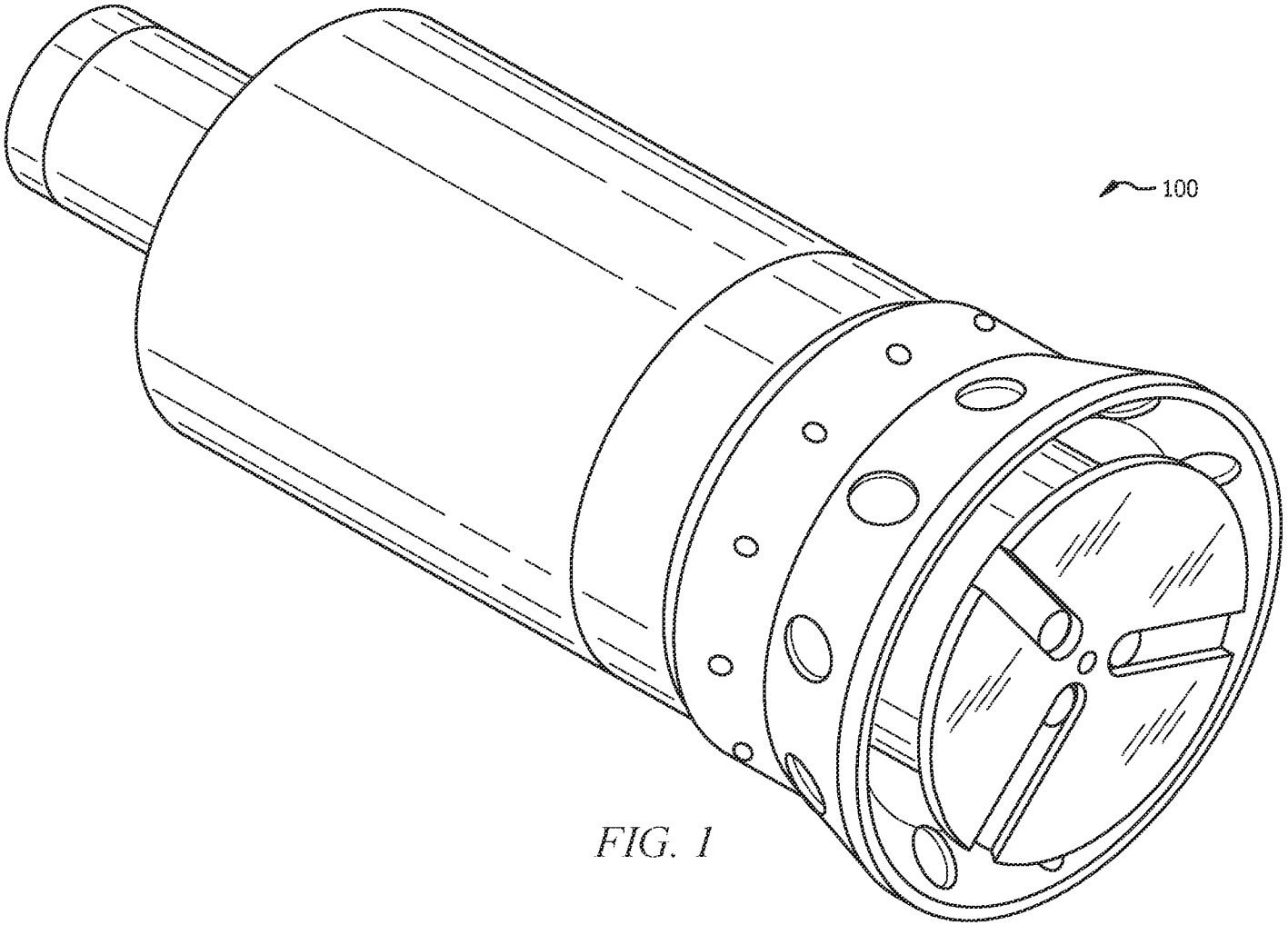
FIG. 1 is a perspective view of a PPD electrode assembly, according to embodiments of this disclosure.

It should be understood at the outset that although an illustrative implementation of one or more embodiments are provided below, the disclosed systems and/or methods can be implemented using any number of techniques, whether currently known or in existence. The disclosure should in no way be limited to the illustrative implementations, drawings, and techniques below, including the exemplary designs and implementations illustrated and described herein, but can be modified within the scope of the appended claims along with their full scope of equivalents.

Pulsed power drilling hard rock formations for oil and gas exploration is based on an Alternative Rock Removal System technology which is disparate from the existing drilling technology of a rotating drill bit. The current state of the art drilling technology utilizes a rotating drill bit to shear the rock. In extremely hard formations, the drilling rates using this conventional approach can be very low (e.g., ranging from 1 to 4 m/h) and can thus make it expensive to drill in pre□salt carbonate reservoirs and other very hard formations.

A pulsed power drilling system breaks with the paradigm by looking at an unconventional and innovative approach to drilling very hard formations. The Alternative Rock Removal System uses electrical power directly on the formation in a form that fractures and excavates the formation rock. This new method of drilling holds the promise of drilling rates in very hard formations of more than 20 m/h, with peak drilling rates of perhaps as high as 40 m/h, improving the current state of the art by an order of magnitude. The Alternative Rock Removal System would replace the typical mechanical drilling tools like mud motors or rotary steerables and the mechanical drill bit with a high power electric generator, pulse power system and electrodes.

In a pulsed power drilling system, the hydraulic power from the drilling fluid is converted to mechanical power which in turn is converted to electrical power. The electrical power is then conditioned to output the appropriate electrical pulses and delivers them to the rock formation through the electrodes. This disclosure provides a system and method for producing an electrode assembly for such a pulsed power drilling system.

The electrodes, as detailed hereinbelow, serve several key functions in the pulsed power drilling system. The electrodes need to be strong and tough enough to support the drill string and, since the electrode(s) are in contact with the formation during drilling, the electrodes are fabricated from wear and erosion resistant materials. The electrodes are also in the electrical current path and therefore need to be able to transmit high currents from the drilling system to the rock formation without excessive ablation or electrical breakdown.

Pulsed-power drilling (PPD) can thus be utilized to form wellbores in subterranean rock formations for recovering hydrocarbons, such as oil and gas, from these formations. Electro-crushing drilling uses pulsed-power technology to fracture the rock formation by repeatedly delivering electrical arcs or high-energy shock waves to the rock formation. A PPD electrode assembly is akin to drill bits in the conventional sense of oil and gas drilling, and will be referred to herein as a "PPD drill bit" or simply "drill bit". A drill bit of a PPD system can be excited by a train of high-energy electrical pulses that produce high power discharges through the formation at the distal end of the drill bit. The discharges produced by the high-energy electrical pulses, in turn, fracture part of the formation proximate to the drill bit and produce electromagnetic and acoustic waves that carry further information about properties of the formation.

As noted above, an electromagnetic pulse drilling bit requires highly electrically conductive material that exhibits superior abrasion/erosion resistant properties along with superior electrical wear resistance. Components of the PPD drill bit include electrode portions that have one or more electrode(s), and ground ring(s) that come directly in contact with the formation. These components can be expected to carry voltages in the range of 100 to 150 kilovolts (kV) during down-hole operation.

FIG. 1 is a perspective view of a PPD electrode assembly or drill bit 100, according to embodiments of this disclosure. As noted above, according to this disclosure, a component of PPD electrode assembly or drill bit 100 comprises a functional gradient of material from a first portion to a second portion of the PPD component. The PPD component can comprise, for example, a ground ring, or an electrode portion (sometimes referred to herein as simply an "electrode") of PPD electrode assembly 100. Although shown as an extendable electrode assembly 100 in FIG. 1 and an extendable electrode portion 300 in FIG. 3, other configurations (e.g., non-extendable) are included in this disclosure.

Ground ring 200 and electrode section 300 can be very complex (e.g., including flow ports) that require extreme erosion resistance. A challenge is that the electric wear on these PPD components can be extreme, and accordingly the PPD components are expected to possess very good electrical wear resistance. Conventional hard materials can be utilized to address the wear part, but can fail as a result of continuous discharge from the pulsed power tool. Ideal material for these PPD components provide a combination of properties, including very low electrical resistivity, high conductivity, high (pulsed power) electrical discharge ablation resistance and superior abrasion/erosion wear resistance properties.

According to this disclosure, a pulsed power drilling (PPD) component comprises a functional gradient of material from a first portion to a second portion of the PPD component. The functional gradient of material provides a greater wear resistance of the first portion relative to the second portion and a greater electrical conductivity or resistivity of the second portion relative to the first portion.

The wear resistance can be measured with a variety of ASTM standards, such as ASTM G65 or ASTM G99, ASTM G76, ASTM G75, and/or by performing customized functional wear testing that has elements of abrasion, erosion and/or impact wear present in the test set-up. For example, the wear resistance can be measured as abrasive wear resistance, via for example ASTM G65, dry erosive wear, via, for example, ASTM G76, and/or slurry abrasion wear, via, for example, ASTM G75. The electrical resistivity can be measured via a combination of ASTM B193 and through functional testing, such as via a Marx generator. As detailed hereinbelow, the functional gradient of material can be produced by binder jetting the first portion and the second portion of the PPD component. The PPD component can comprise one or more first portions and one or more second portions; that is, one or more first portions can have different properties from one or more second portions of the PPD component.

Figure 2A:
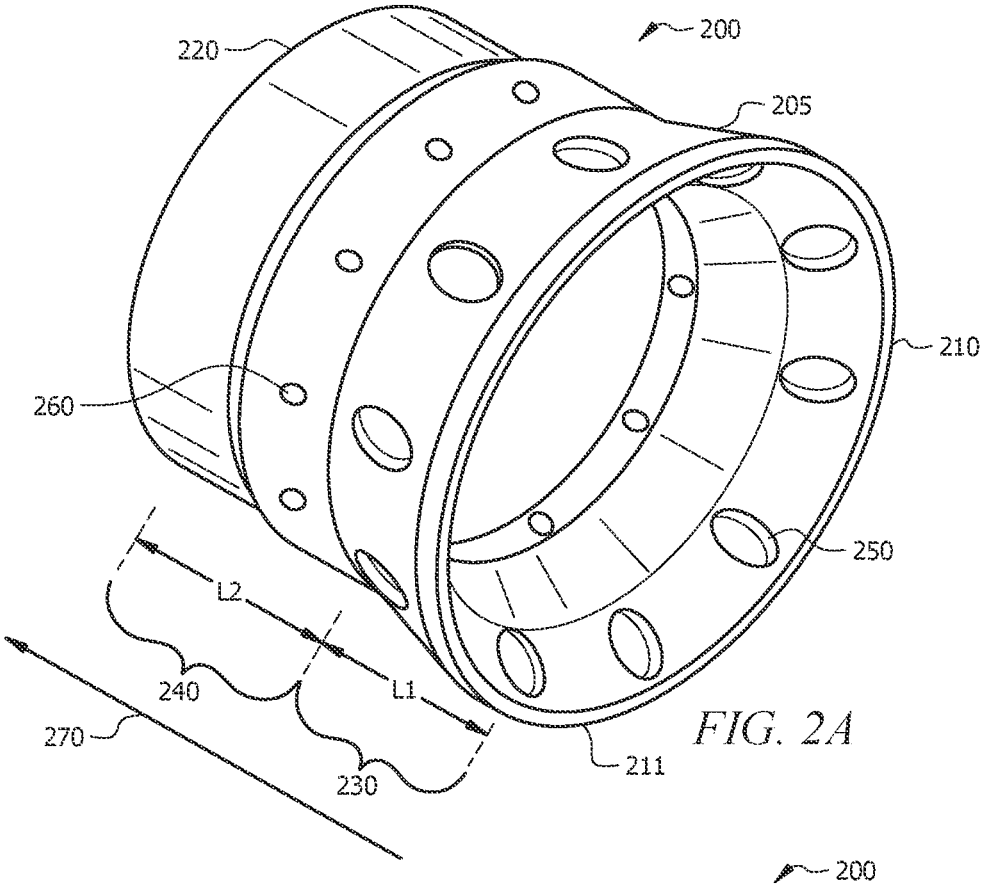
FIG. 2A is a perspective view of a ground ring, according to embodiments of this disclosure.
Figure 2B:
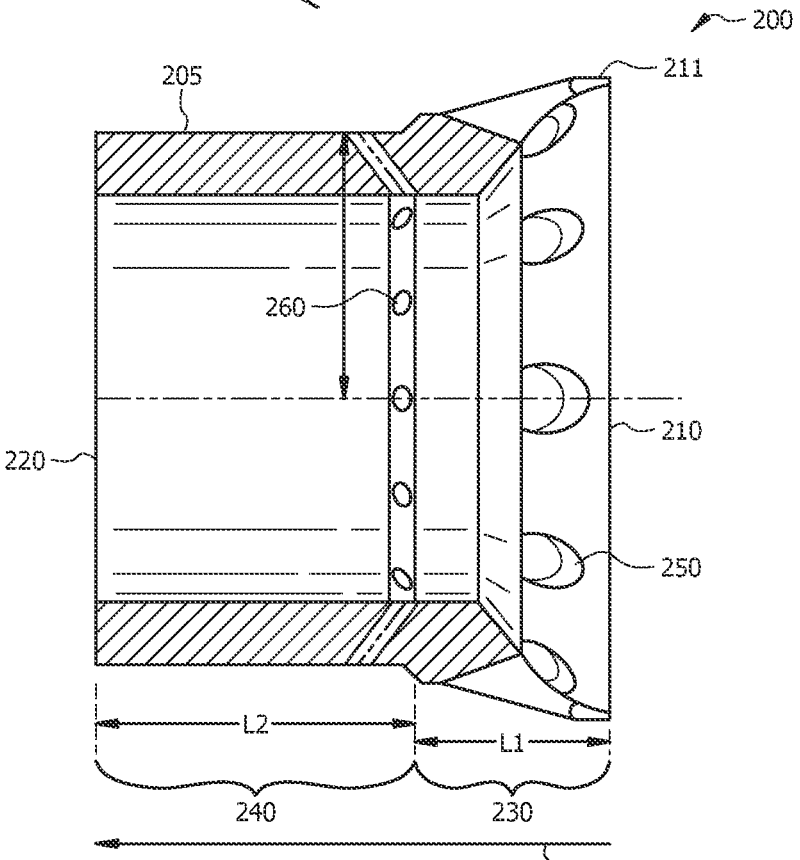
FIG. 2B is a side view of the ground ring of FIG. 2A.

FIG. 2A is a perspective view of an example ground ring 200 of an electrode assembly 100, according to embodiments of this disclosure; FIG. 2B is a side view of the ground ring 200 of FIG. 2A. Ground ring 200 comprises a generally cylindrical outer wall 205, a first end 210, a second end 220, a first portion 230, a second portion 240, and flow ports 250. First portion 230 can comprise or consist of first end 310 and can extend from a location at or near first end 210 a distance or length L1 toward second end 220. Second portion 240 can comprise or consist of second end 220, and can extend from a location at or near second end 210 a distance or length L2 toward first end 210. Flow ports 250 can be located in the first portion 230. First portion 230 can be proximate and/or comprise first end 210, and second portion 240 can be proximate and/or comprise second end 220. Second portion 240 can be generally at or near an opposite end of the PPD component (e.g., ground ring 200) from the first portion 230. The first portion 230 can include a portion of the PPD component (e.g., ground ring 200) that will be (e.g., directly) exposed to the formation rock, while second portion 340 can include a portion of the PPD component that will be (e.g., directly) exposed to electrical discharge. The portion exposed to electrical discharge can include a bottom face 311 of the electrode 300 and a leading edge 211 of ground ring 200. As described further hereinbelow, according to this disclosure, a functional gradient of material 270 exists between first portion 230 (e.g., first end 210) and second portion 240 (e.g., second end 220).

Figure 3A:
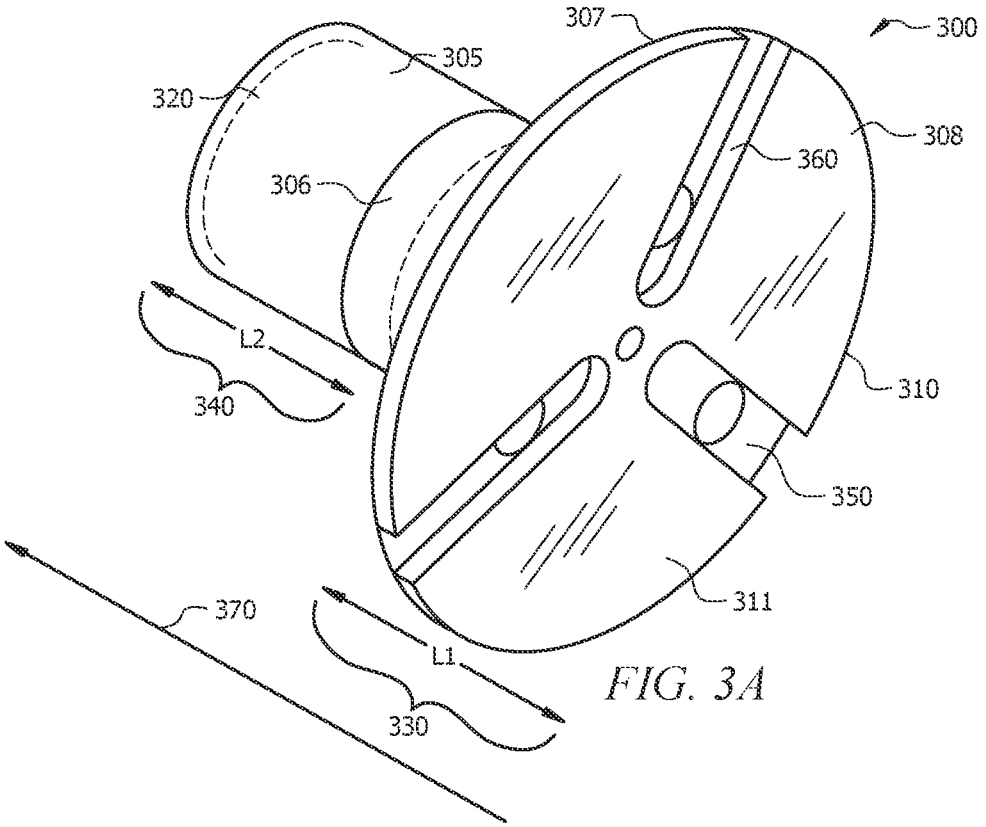
FIG. 3A is a perspective view of an electrode portion, according to embodiments of this disclosure.
Figure 3B:
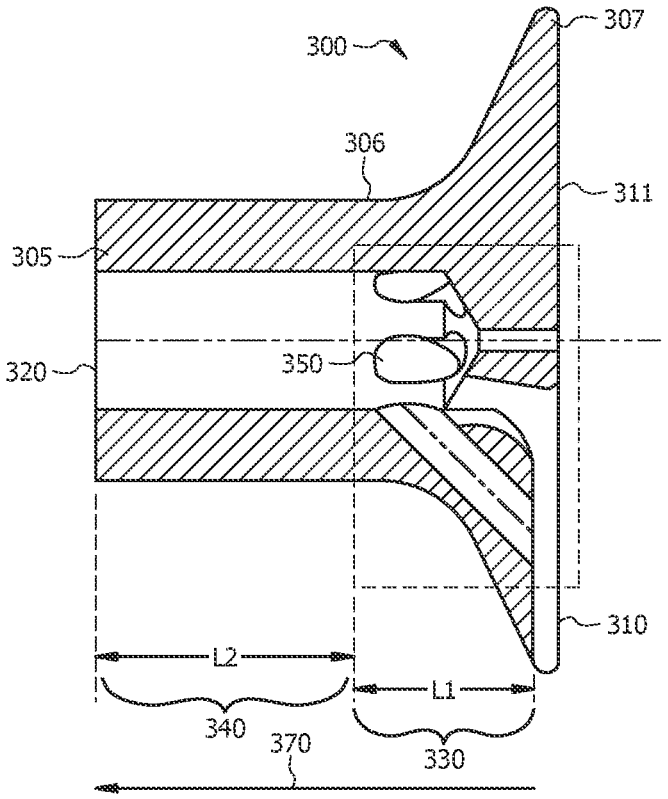
FIG. 3B is a side view of the electrode portion of FIG. 3A.

FIG. 3A is a perspective view of an electrode section 300, according to embodiments of this disclosure; FIG. 3B is a side view of the electrode section 300 of FIG. 3A. Electrode section 300 comprises a generally cylindrical base 305 connected via intermediate section 306 to a disk-shaped head 307. A first end 310 is distal a second end 320 of electrode section 300. First portion 330 can comprise or consist of first end 310 and can extend from a location at or near first end 310 a distance or length L1 toward second end 320. Second portion 340 can comprise or consist of second end 320, and can extend from a location at or near second end 310 a distance or length L2 toward first end 310. Ports 350 can be formed within channels 360 of disk-shaped head 307. Channels 360 can divide disk-shaped head 307 into wedges 308. For example, in FIG. 3A and FIG. 3B, three channels 360 divide disk-shaped head 307 into three symmetrical wedges 308. More or fewer (e.g., no) channels 360 can be included in electrode section 300, and can divide disk-shaped head 307 into one, two, three, four, five or more wedges 308. One or more of the wedges 308 can be symmetrical and/or one or more of the wedges 308 can be non-symmetrical. Ports 350 can be located in the first portion 330. First portion 330 can be proximate and/or comprise first end 310, and second portion 340 can be proximate and/or comprise second end 320. Second portion 340 can be generally at or near an opposite end of the PPD component (e.g., electrode section 300) from the first portion 330. As described further hereinbelow, according to this disclosure, a functional gradient of material 370 exists between first portion 330 (e.g., first end 310) and second portion 340 (e.g., second end 320).

Although a specific ground ring 200 and electrode section 300 are depicted in FIGS. 2A-2B and FIGS. 3A-3B, respectively, it should be understood that other components of an electrode assembly 100, different ground rings than ground ring 200 depicted in FIGS. 2A-2B, and different electrode sections than electrode section 300 depicted in FIGS. 3A-3B can comprise the functional gradient of material from a first portion to a second portion thereof, wherein the functional gradient of material provides a greater wear resistance of the first portion relative to the second portion and a greater electrical conductivity or resistivity of the second portion relative to the first portion, and are thus intended to be within the scope of this disclosure. For example, while the ground ring 200 of FIG. 2A and FIG. 2B and the electrode 300 of FIG. 3A and FIG. 3B are substantially cylindrical and round in cross section, ground rings and electrodes having other shapes (e.g., oval, polygonal, triangular, square, pentagonal, etc., are intended to be within the scope of this disclosure.

The functional gradient of material 370/470 of ground ring 200/electrode section 300 provides for a greater wear resistance of the first portion 230/330 relative to the second portion 240/340 and a greater electrical conductivity or resistivity of the second portion 240/340 relative to the first portion 230/330.

The functional gradient of material 370/470 can be continuous or stepwise from the first portion to the second portion. For example, a ground ring 200 or electrode section 300 of this disclosure can comprise a continuous gradient of material from first portion 230/330 or first end 210/310 to second portion 240/340 or second end 220/320. The first portion 230/330 can comprise a uniform composition of (e.g., first) material along the length L1 thereof, and the second portion 240/340 can comprise a uniform composition of (e.g., second) material along the length L2 thereof, so long as the functional gradient of material 270/370 exists between the first portion 230/330 and the second portion 240/340. Alternatively, a gradient of material can exist along the length L1 of the first portion 230/330 and/or along the length L2 of the second portion 240/340.

The material (e.g., first material, second material) can comprise tungsten carbide (WC) and a binder selected from copper (Cu), cobalt (Co), nickel (Ni), or a combination thereof. The gradient of material can be provided by a first composition of the binder in the first portion 230/330 (e.g., first end 210/310) that is different from a second composition of the binder in the second portion 240/340 (e.g., second end 220/320).

A straight binder chemistry, such as WC—Co or WC—Ni, can be utilized. In embodiments, optimized binder chemistries can be employed to improve resistivity or erosion-corrosion resistance. For example, CoCu alloys can be leveraged for resistivity while CuNiCo alloys can be leveraged for erosion-corrosion resistance at the expense of some resistivity. Copper can be utilized as the conducting mechanism while cobalt can be utilized to improve wettability and corrosion resistance. Due to the two phase nature and the effect of grain boundary crossing on resistivity, CoCu alloys can be limited to Cu amounts between 52% to 99%. For improved corrosion resistance at the expense of resistivity, Co amounts can be limited to 52% to 99%. Ternary alloying (CuNiCo) to employ improved corrosion resistance and strength at the expense of some resistivity can employ compositions of 90 to 99 weight percent (wt %) Cu, less than 3 wt % Co, and the balance nickel (Ni).

Via binder jetting, described herein, the PPD component composition and design can be optimized for wear, corrosion, electrical conductivity, and/or light weight. For example, a functional based grading can be utilized, since binder jetting provides such grading in terms of both continuous or discreet grading.

Figure 4A:
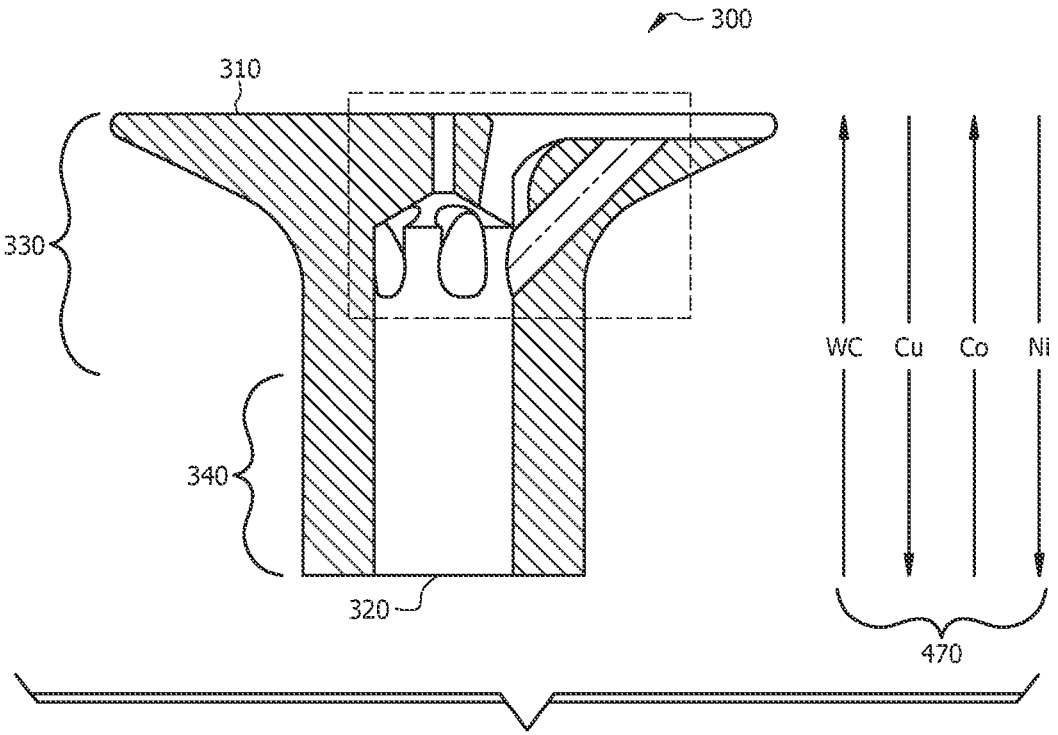
FIG. 4A is a side view of a ground ring, showing a functional gradient of material, according to embodiments of this disclosure.
Figure 4B:
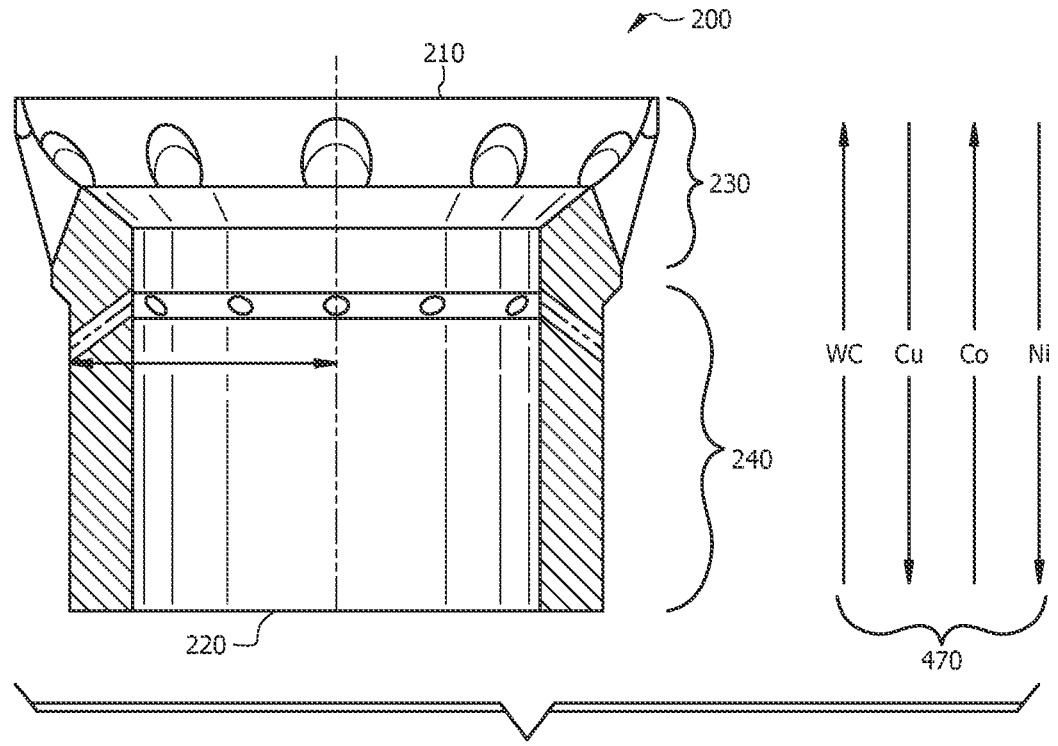
FIG. 4B is a side view of an electrode portion, showing a functional gradient of material, according to embodiments of this disclosure.

For example, FIG. 4A is a side view of a ground ring 200, showing a functional gradient of material 470, and FIG. 4B is a side view of an electrode section 300, showing the functional gradient of material 470, according to embodiments of this disclosure. Gradient 470 comprises an increase of copper (Cu) and nickel (Ni) going from first end 210/310 to second end 220/320 and from first portion 230/330 to second portion 240/340. Gradient 470 comprises an increase of tungsten carbide (WC) and cobalt (Co) going from first end 210/310 to second end 220/320 and from first portion 230/330 to second portion 240/340. The functional gradient 470 can be continuous from first end 210/310 to second end 220/320 or stepwise from first portion 230/330 to second portion 240/340.

As seen in FIG. 4A and FIG. 4B, WC can be the hard phase primary for the wear resistance. The ternary binder of a Cu—Ni—Co system can be apportioned throughout the PPD component (e.g., ground ring 200, electrode portion 300) according to the functional need. Hence on a formation facing side (e.g., first end 310/210) of the electrode section 300, as well as the ground ring 200, the chemistry can be WC with a ternary phase rich in cobalt for better erosion resistance and interfacial strength. However on the opposite end (e.g., second end 320/220) of the PPD component, the binder can be rich in Cu—Ni for enhanced electrical conductivity.

In embodiments, the binder jetting can be applied to a conductive substrate that has much better conductivity, such as Cu—Be—Ni alloys, Cu—Be—Co—Zr or Cu—Be—Co alloys. Alloys in the aforementioned families such as Alloy 3, Alloy 10 and alloys 10× can be utilized, in embodiments.

In embodiments, the first composition of the binder comprises more cobalt (Co) than the second composition of the binder. In some such embodiments, the second composition of the binder comprises more copper, nickel, or both than the first composition of the binder. In embodiments, the first composition of the binder comprises cobalt (Co), and the second composition of the binder comprises nickel (Ni). In embodiments, the first composition of the binder comprises cobalt (Co) and copper (Cu), and from about 52 to about 99 weight percent (wt %) of the first composition of the binder comprises cobalt (Co). In embodiments, the second composition of the binder comprises cobalt (Co) and copper (Cu), and from about 52 to about 99 weight percent (wt %) of the second composition of the binder comprises copper (Cu).

In embodiments, the binder comprises copper (Cu), nickel (Ni), and cobalt (Co). In some such embodiments, the first binder composition comprises from about 90 to 99 weight percent (wt %) Cu, less than 3 wt % Co, and the balance nickel.

The PPD component (e.g., ground ring 200, electrode section 300, or another component of a PPD electrode assembly 100 can be configured to carry voltages in a range of from about 100 kilovolts (kV) to 150 kV during operation of a PPD electrode assembly 100 comprising the PPD component.

Figure 5:
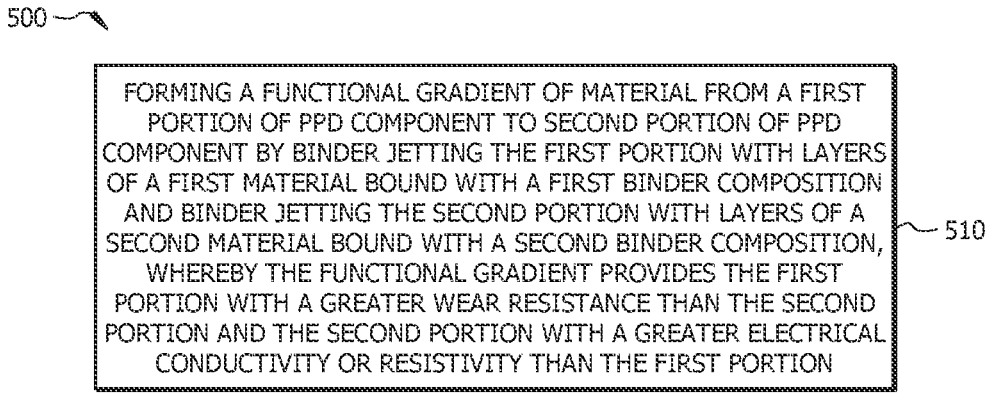
FIG. 5 is a schematic flow diagram of a binder jetting method, according to embodiments of this disclosure.
Figure 6:
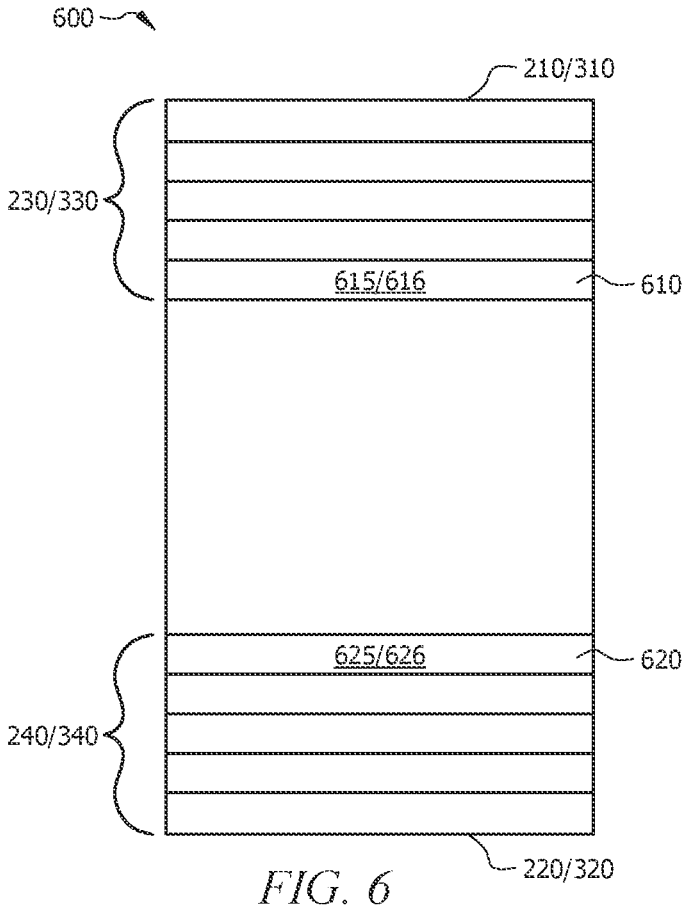
FIG. 6 is a schematic of an example PPD component, according to embodiments of this disclosure.

Also provided herein is a method of making a PPD component. Such a method will now be described with reference to FIG. 5, which is a schematic flow diagram of a binder jetting method 500, according to embodiments of this disclosure, and FIG. 6, which is a schematic of an example PPD component 600 (which can be a ground ring, such as ground ring 200 of FIG. 2, an electrode section, such as electrode section 300 of FIG. 3, or another component of PPD electrode assembly 100), according to embodiments of this disclosure. As depicted in FIG. 5, method 500 comprises, at 510, forming a functional gradient in material from a first portion 230/330 of the PPD component 200/300 to a second portion 240/340 of the PPD component 200/300. Forming the functional gradient 270/370 can be effected by binder jetting the first portion 230/330 with layers 610 of a first material 615 bound with a first binder composition 616 and binder jetting the second portion 240/340 with layers 620 of a second material 625 bound with a second binder composition 626. The functional gradient 270/370 of material can provide the first portion 230/330 with a greater wear resistance than the second portion 240/340 and the second portion 240/340 with a greater electrical conductivity or resistivity than the first portion 230/330. In embodiments, the first portion 230/330 has a greater abrasion/erosion wear resistance, a higher electrical conductivity, and/or a higher electrical wear/ablation resistance than the second portion 240/340. For example, in embodiments, the first portion is designed to contact and/or be proximal to the formation and can be more wear resistant and conductive than a second portion, which can, for example, be more ductile and, as a result, can be more resistive or more conductive. The mechanical, electrical and/or wear properties across the component (e.g., ground ring 200 or electrode 300) and potentially in specific regions thereof (e.g., first portion, second portion, for example at port holes, can have more erosion resistance, versus ductility in any threaded holes, etc.).

Figure 7:
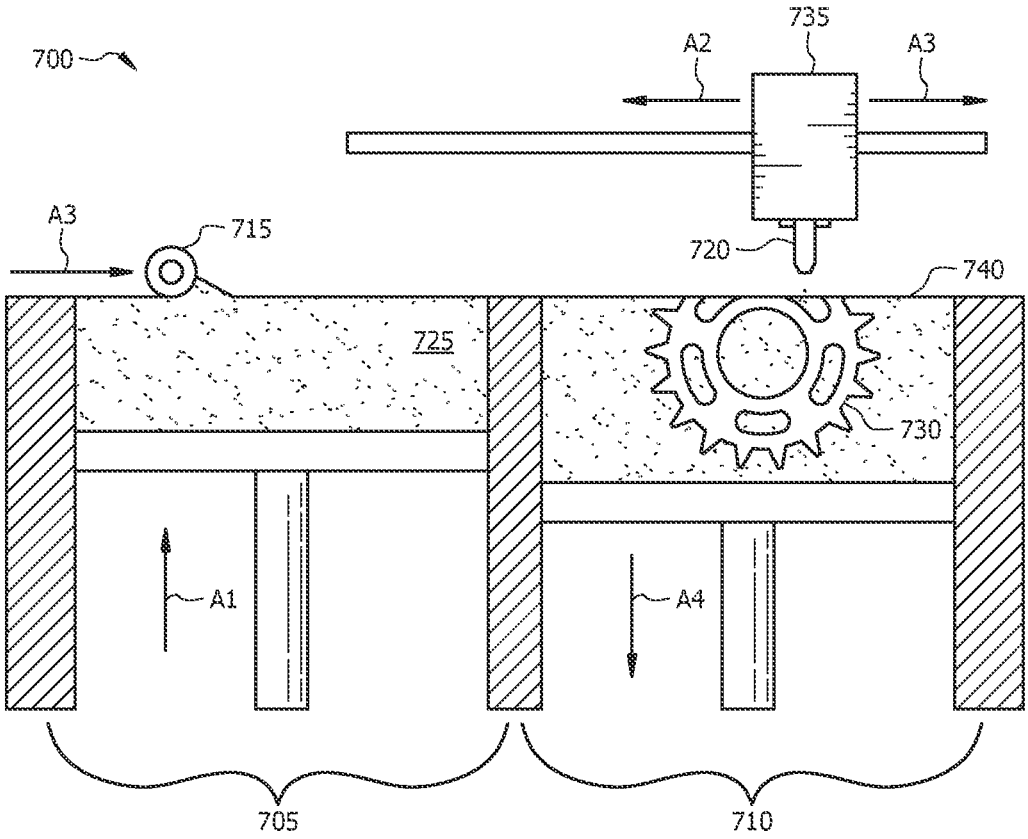
FIG. 7 is a schematic of a binder jetting system, according to embodiments of this disclosure.

Binder jetting can be performed utilizing a binder jetting system, such as binder jetting system 700 of FIG. 7, which is a schematic of a binder jetting system 700, according to embodiments of this disclosure. Binder jetting system 700 can include a build tank 710, a powder feed tank 720, a powder roller 715, and an inkjet printhead 720. A layer of metal powder 725 from powder feed tank 705 can be fed via movement in a direction indicated by arrow A1 and movement in a direction A3 via powder roller 715 atop build tank 710. Liquid binder 735 can be positioned as desired over the layer via inkjet printhead 720, which can move over the layer in direction A2 or A3. Layer by layer, a green part 730 having the configuration of the PPD component 600 can be created. Upon completion of all the layers 610/620 of material bound with the desired binder composition (e.g., layers 610 of the first material 615 bound with the first binder composition 616 in the first portion 230/330 of the PPD component 600 and the layers 620 of the second material 625 bound with the second binder composition 626 in the second portion 240/340 of the PPD component 600), the green part 730 can be separated from the loose powder 740 surrounding it in the build tank 710. The green part 730 can be sintered to provide the PPD component 700.

Accordingly, in sintering-based processes, such as the binder jetting of method 500, a layer (610, 620) of powder 740 can be spread across the powder bed 725 and a binder 735 (e.g., a liquid polymer agent) from an inkjet print head 720 can be selectively deposited to bond powder particles to form the green compact 730, as schematically shown in FIG. 7. After the print, the green part 730 can be cured to improve green strength, de-powdered to remove unbound powder 740, de-bound to remove the binder 735, and sintered to reach full density.

Sintering involves material transport within a porous body from one region to another that can provide strong particle bonds, changes in pore size and distribution, and a reduction and eventual elimination of porosity. A liquid phase is typically involved. The cured and de-powdered printed part 730 can be a mixture of carbide (e.g., tungsten carbide) grains, cobalt grains, and binder, for example. At these stage the powders are held by the cured binder and Van der Waals forces and the part density is typically about 55 to 65%. Sintering and shrinkage of the part can begin around 800° C. and continue until the final sintering temperature of about 1400° C. Although referred to as "liquid phase sintering", a majority of the shrinkage can occur before the liquid even forms. Post sintering the parts are densified to achieve 98 to 99.5% of the density. An optional hot isostatic pressing (HIP) process can be applied to achieve even higher density, e.g., between 99.8 to 100% of the density.

The binder jetting system 700 and method 500 can provide flexibility for light-weighting by enabling incorporation of lattice structures for the PPD component(s).

As noted hereinabove, the functional gradient 270/370 of material created via method 500 can be continuous or stepwise from the first portion 230/330 to the second portion 240/340. The functional gradient 270/370 can be continuous from a first end 210/310 of the PPD component 600 to a second end 220/320 of the PPD component 600, wherein the first portion 230/330 comprises the first end 210/310 of the PPD component 600, and the second portion 240/340 comprises the second end 220/320 of the PPD component.

A variety of materials (e.g., first material 615, second material 616) and binder compositions (e.g., first binder composition 616, second binder composition 626) can be utilized. In embodiments, the first material 615 and the second material 625 comprise tungsten carbide (WC). The first binder composition 616 can comprise cobalt (Co). An amount of Co in the first binder composition 616 can be greater than an amount of Co in the second binder composition 626. In some such embodiments, the first binder composition 615 can comprise cobalt (Co) and copper (Cu), having from about 52 to 99 weight percent (wt %) Co.

In embodiments, the second binder composition 626 can comprise copper (Cu), nickel (Ni), or both Cu and Ni, and an amount of Cu, an amount of Ni, or both an amount of Cu and an amount of Ni in the second binder composition 626 is greater than an amount of Cu, an amount of Ni, or an amount of Cu and an amount of Ni, respectively, in the first binder composition 616. In examples, the second binder composition 626 comprises Co and Cu. In some such embodiments, the second binder composition 626 can comprise from about 52 to about 99 weight percent (wt %) Cu.

In examples, the first binder composition 616 comprises or consists essentially of cobalt (Co) and the second binder composition 626 comprises or consists essentially of nickel (Ni). In examples, the first binder composition 616, the second binder composition 626, or both the first binder composition 616 and the second binder composition 626 comprise cobalt (Co), copper (Cu), and nickel (Ni).

Also disclosed herein is a pulsed power drilling (PPD) component 600 (e.g., a ground ring, such as ground ring 200 of FIG. 2, an electrode section, such as electrode section 300 of FIG. 3, or another component, such as PPD component 600 of FIG. 6 of a PPD electrode assembly, such as PPD electrode assembly 100 of FIG. 1) produced as described herein.

Figure 8:
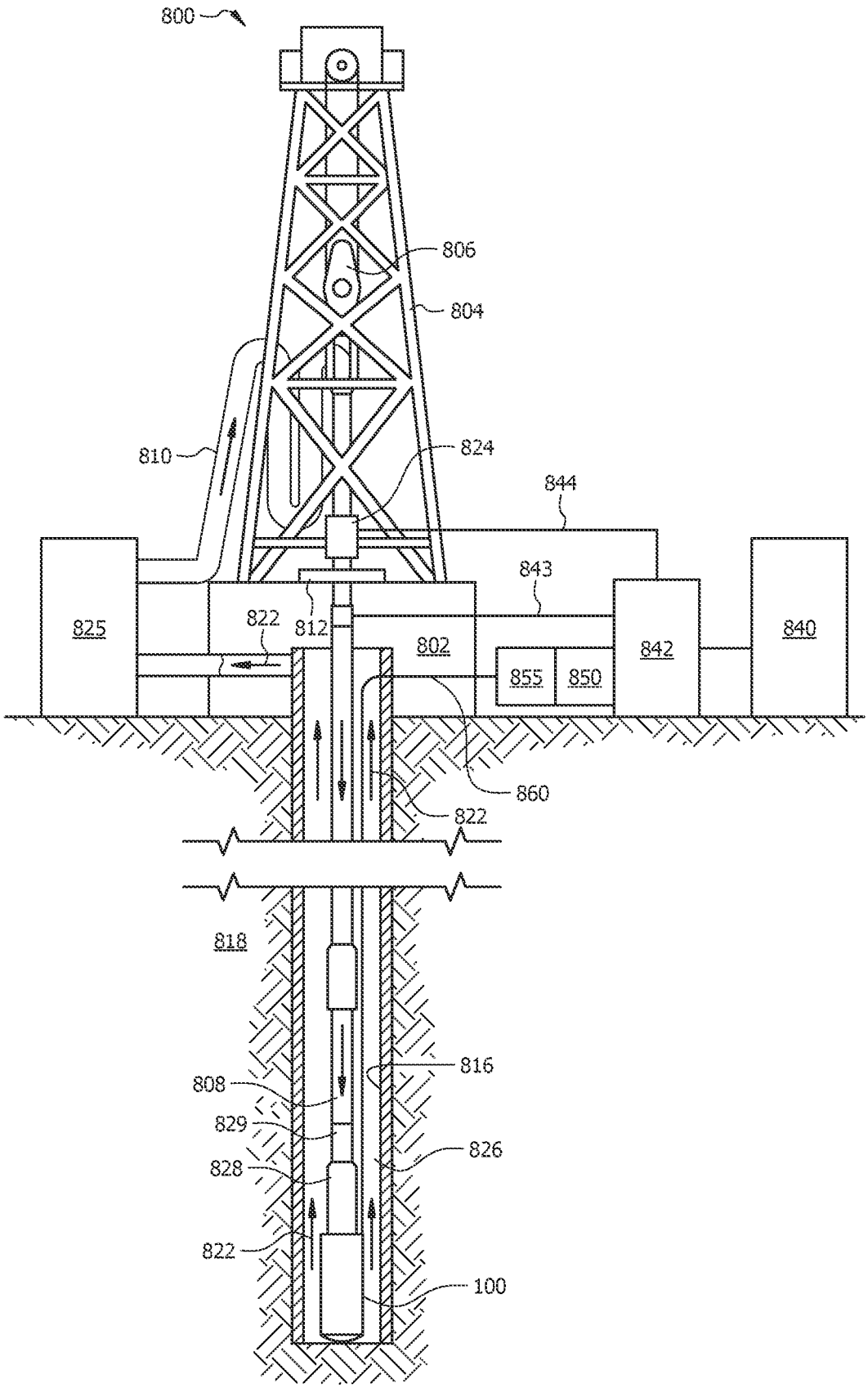
FIG. 8 is an elevation view of an example PPD system used in a wellbore environment.

FIG. 8 is an elevation view of an exemplary PPD system 800 used to form a wellbore in a subterranean formation 818. Although FIG. 8 shows land-based equipment, downhole tools incorporating teachings of the present disclosure may be satisfactorily used with equipment located on offshore platforms, drill ships, semi-submersibles, and drilling barges (not expressly shown). Additionally, while wellbore 816 is shown as being a generally vertical wellbore, wellbore 816 may be any orientation including generally horizontal, multilateral, or directional.

PPD system 800 includes drilling platform 802 that supports derrick 804 having traveling block 806 for raising and lowering drill string 808. Drill string 808 may be raised and lowered using a draw-works, such as a machine on the rig including a large diameter spool (not shown) of wire rope. The draw-works may be driven by a power source, such as an electric motor (not shown), or hydraulically to spool-in the wire rope to raise the drill string. The draw-works may be able to spool-out the wire rope to lower the drill string under the force of gravity acting on the drill string within the wellbore. The draw-works may include a brake to control the lowering of the drill string. The draw-works may include a crown block which, together with traveling block 806, form a block and tackle with several windings of the wire rope between them for mechanical advantage. Sensors may be mounted on or proximate to the draw-works spool to measure the rotation, from which changes in the depth of the drill string may be calculated. Time may also be measured and, together with the calculations of changes in depth, may enable the calculation of instantaneous and average rates of penetration (ROP). PPD system 800 may also include pump 825, which circulates drilling fluid 822 (also called "mud") through a feed pipe to kelly 810, which in turn conveys drilling fluid 822 downhole through interior channels of drill string 808 and through one or more fluid flow ports in pulsed-power drill bit 100. Drilling fluid 822 circulates back to the surface via annulus 826 formed between drill string 808 and the sidewalls of wellbore 816. Fractured portions of the formation (also called "cuttings") are carried to the surface by drilling fluid 822 to remove those fractured portions from wellbore 816. Drilling fluid 822 and cuttings returning from downhole to the surface may flow over a shale shaker or another device that removes the cuttings from drilling fluid 822. The portion of drilling fluid 822 returned from downhole to the surface may be collected in surface tanks and may be tested by personnel or through automated fluid management systems, after which an adjustment to drilling fluid may be initiated. For example, a person or automated system may examine, and subsequently initiate an adjustment to, properties of drilling fluid 822 that may have changed as a result of processes in wellbore 816.

Sensors may be employed at the surface, e.g., at the shale shaker or along the flow lines through which drilling fluid 822 is returned to the surface, to examine the properties of the cuttings and drilling fluid 822 returned to the surface. Gas entrained in drilling fluid 822 or cuttings may be captured and analyzed by personnel or the volume and/or other characteristics of the entrained gas may be directly measured by sensors at the surface.

Drilling fluid 822 may have rheological properties for removing cuttings from wellbore 816. Drilling fluid 822 may also have electrical properties conducive to particular PPD operations. Drilling fluid 822 may be or include oil based fluids or water-based fluids, depending upon the particular pulsed power drilling approach utilized. Drilling fluid 822 may be formulated to have high dielectric strength and a high dielectric constant, so as to direct electrical arcs into the formation rather than them being short circuited through drilling fluid 822.

PPD system 800 may include valve 824 at the surface. The opening and closing of valve 824 may be controlled to create pressure pulses, sometimes referred to as mud pulses, in drilling fluid 822 that convey commands or other information to various downhole components. The pressure pulses, or mud pulses, may be sensed by a sensor at the BHA, e.g., a pressure sensor ported to the flow path of drilling fluid 822 through the BHA tubular elements. The resulting sensor signals may inform or be translated (e.g., by a processor) into commands used in controlling a PPD operation. The resulting sensor signals may be translated by various actuators into other types of control signals used to control a PPD operation.

Valve 824 may be positioned anywhere along the flow path of drilling fluid 822 from mud pump 825 to kelly 810. In one example, valve 824 may be in-line with the flow path and may, when activated, cause or relieve a restriction in the flow path to create mud pulses. In another example, valve 824 may be positioned to vent or bypass a portion of drilling fluid 822 or to make a change to a bypass from the main flow path of drilling fluid 822 to kelly 810 and drill string 808 to create mud pulses. In this example, the portion of drilling fluid 822 vented using valve 824 may then be returned by other pipes or tubular elements to mud tanks on the surface or to an inlet of mud pump 825. Valve 824 may include a solenoid or other mechanism for activation and may be controlled using an electrical signal input or a digital command.

Valve 824 may include a rotor and stator within the path of drilling fluid 822 to create periodic brief interruptions or restrictions in the flow of drilling fluid 822 as the turbine vanes cross the openings between the stator vanes. The rotor speed may be modulated (e.g., via electrical or mechanical braking) using an electrical control system, thus changing the periodicity or frequency of the interruptions and corresponding perturbations or pulses within drilling fluid 822.

Pulsed-power drill bit 100 is attached to the distal end of drill string 808 and may be an electro-crushing drill bit or an electrohydraulic drill bit. Power may be supplied to drill bit 100 from components downhole, components at the surface and/or a combination of components downhole and at the surface. For example, generator 840 may generate electrical power and provide that power to power-conditioning unit 842. Power-conditioning unit 842 may then transmit electrical energy downhole via surface cable 843 and a subsurface cable (not expressly shown in FIG. 8) contained within drill string 808 or attached to the outer wall of drill string 808. A pulse-generating (PG) circuit within BHA 828 may receive the electrical energy from power-conditioning unit 842 and may generate high-energy electrical pulses to drive drill bit 100. The high-energy electrical pulses may discharge through the rock formation and/or drilling fluid 822 and may provide information about the properties of the formation and/or drilling fluid 822. The PG circuit within BHA 828 may be located near drill bit 100. The PG circuit may include a power source input, including two input terminals, and a first capacitor coupled between the input terminals. The pulse generating circuit may include a first inductor coupled between the input terminals with associated opening switch and a first capacitor coupled to the two ends of the inductor. The PG circuit may also include a switch, a transformer, and a second capacitor whose terminals are coupled to respective electrodes of drill bit 100. The switch may include a mechanical switch, a solid-state switch, a magnetic switch, a gas switch, or any other type of switch suitable to open and close the electrical path between the power source input and a first winding of the transformer.

The transformer generates a current through a second winding when the switch is closed and current flows through first winding. The current through the second winding charges the second capacitor. As the voltage across the second capacitor increases, the voltage across the electrodes of the drill bit increases. The transformer can include a segmented primary transformer including multiple primary windings and a single secondary winding. In another example, the transformer may be a magnetic core transformer. The pulse generating circuit may also include a first inductor coupled between the input terminals with an associated opening switch and a second capacitor whose terminals are coupled to each end of the first inductor and to respective electrodes of drill bit 100. The first inductor may be an air core inductor or a magnetic core inductor and may generate the full voltage needed by the second capacitor for drilling. The inductor may be a segmented inductor including multiple windings with respective opening switches.

The PG circuit within BHA 828 may be utilized to repeatedly apply a large electric potential across the electrodes of drill bit 100. For example, the applied electric potential may be in the range of 150 kilovolts (kV) to 300 kV or higher. In this example, the lower bound on the applied electric potential may correspond to a lower bound on pulsed current of 600 amps. In another example, the lower bound on the applied electric potential may be 80 kV, with a lower bound on pulsed current of 600 amps. In yet another example, the lower bound on the applied electric potential may be 60 kV, again with a lower bound on pulsed current of 600 amps.

Each application of electric potential is referred to as a pulse. The high-energy electrical pulses generated by the PG circuit may be referred to as pulse drilling signals. When the electric potential across the electrodes of drill bit 100 is increased enough during a pulse to generate a sufficiently high electric field, an electrical arc forms through rock formation 818 at the distal end of wellbore 816. The arc temporarily forms an electrical coupling between the electrodes of drill bit 100, allowing electric current to flow through the arc inside a portion of the rock formation at the distal end of wellbore 816. The arc greatly increases the temperature and pressure of the portion of the rock formation through which the arc flows and the surrounding formation and materials. The temperature and pressure are sufficiently high to break the rock into small bits referred to as cuttings. This fractured rock is removed, typically by drilling fluid 822, which moves the fractured rock away from the electrodes and uphole. The terms "uphole" and "downhole" may be used to describe the location of various components of PPD system 800 relative to drill bit 100 or relative to the distal end of wellbore 816 shown in FIG. 8. For example, a first component described as uphole from a second component may be further away from drill bit 100 and/or the distal end of wellbore 816 than the second component. Similarly, a first component described as being downhole from a second component may be located closer to drill bit 100 and/or the distal end of wellbore 816 than the second component.

The electrical arc may also generate acoustic and/or electromagnetic waves that are transmitted within rock formation 818 and/or drilling fluid 822. Sensors placed within wellbore 816 and/or on the surface may record responses to high-energy electrical pulses, acoustic waves and/or electromagnetic waves. Sensor analysis system (SAS) 850 may, during PPD operations, receive measurements representing the recorded responses and may analyze the measurements to determine characteristics of rock formation 818 or for other purposes. PPD system 800 may also include mud pulse valve 729 downhole. The opening and closing of mud pulse valve 729 may be controlled to create pressure pulses in drilling fluid 822 that convey information to various components on the surface. In one example, an optical fiber may be positioned inside a portion of well bore 816 and a distributed acoustic sensing subsystem may sense the pressure pulses based on changes in strain on the optical fiber and translate them into electrical signals that are provided to SAS 850. Other types of pressure sensing mechanisms at the surface may detect the pressure pulses and translate them into electrical signals that are provided to SAS 850. Pulsed drilling controller (PDC) 855 may determine that a current operating parameter of a PPD operation should be modified based on the analysis performed by SAS 850, and may output a control signal to directly or indirectly alter the operating parameter to be modified.

Wellbore 816, which penetrates various subterranean rock formations 818, is created as drill bit 100 repeatedly fractures the rock formation and drilling fluid 822 moves the fractured rock uphole. Wellbore 816 may be any hole formed in a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 816 may be any hole formed in a subterranean formation or series of subterranean formations for the purpose of geothermal power generation.

Although pulsed-power drill bit 100 is described above as implementing electro-crushing drilling, pulsed power drill bit 100 may also be used for electrohydraulic drilling. In electrohydraulic drilling, rather than generating an electrical arc within the rock, drill bit 100 applies a large electrical potential across the one or more electrodes to form an arc across the drilling fluid proximate to the distal end of wellbore 816. The high temperature of the arc vaporizes the portion of the drilling fluid immediately surrounding the arc, which in turn generates a high-energy shock wave in the remaining fluid. The electrodes of electrohydraulic drill bit may be oriented such that the shock wave generated by the arc is transmitted toward the distal end of wellbore 816. When the shock wave contacts and bounces off of the rock at the distal end of wellbore 816, the rock fractures. Accordingly, wellbore 816 may be formed in subterranean formation 818 using drill bit 100 that implements either electro-crushing or electrohydraulic drilling. The circuit topologies used for electrohydraulic drilling may be the same as, or similar to, those used for electro-crushing drilling with at least some components of the circuits having different values. SAS 850 may be positioned at the surface for use with PPD system 800 as illustrated in FIG. 8, or at any other suitable location. Any suitable telemetry mechanism 860 may be used for communicating signals between downhole components and surface-based components. For example, telemetry mechanism 860 may be used for communicating signals from various acoustic, electrical or electromagnetic sensors at the surface or downhole to SAS 850 during a PPD operation. Telemetry mechanism 860 may include an optical fiber that extends downhole in wellbore 816 and SAS 850 may be coupled to the optical fiber. The optical fiber may be enclosed within a cable, rope, line, or wire. More specifically, the optical fiber may be enclosed within a slickline, a wireline, coiled tubing, or another suitable conveyance for suspending a downhole tool in wellbore 816. The optical fiber may be charged by a laser to provide power to PDC 855, SAS 850, or sensors located within wellbore 816. More specifically, one or more input/output interfaces of SAS 850 may be coupled to the optical fiber for communication to and from acoustic, electrical or electromagnetic sensors positioned downhole. For example, the sensors may transmit measurements to SAS 850. Any suitable number of SASs 850, each of which may be coupled to an optical fiber located downhole, may be placed inside or adjacent to wellbore 816.

PDC 855 may be positioned at the surface for use with PPD system 800 as illustrated in FIG. 8, or at any other suitable location. Any suitable telemetry system may be used for exchanging information by communicating acoustic, electrical or electromagnetic signals to or from PDC 855 during a PPD operation. More specifically, one or more input/output interfaces of PDC 855 may be configured for communication to or from various electrical, mechanical, or hydraulic components located downhole during a PPD operation. For example, PDC 855 may be coupled to telemetry mechanism 860, which may include an optical fiber that extends downhole in wellbore 816.

A variety of types of telemetry systems may be suitable for use in communicating commands from the surface to downhole components of PPD system 800 ("downlinks") and for communicating data from downhole components of PPD system 800 or other BHA elements to the surface ("uplinks"). Telemetry mechanism 860 illustrated in FIG. 8 may represent uplinks and/or downlinks associated with any suitable telemetry system. In some example PPD systems 800, one type of telemetry system may be used for downlinks and another type of telemetry system may be used for uplinks. In some example PPD systems 800, a single type of telemetry may be used for both downlinks and uplinks. In some example PPD systems 800, telemetry may be provided in only one direction (e.g., for downlinks or uplinks, but not both). In some example PPD systems 800, one type of telemetry may be used for a portion of the travel path of the uplinks and/or downlinks, and another type of telemetry may be used for another portion of the travel path of the uplinks and/or downlinks, with suitable couplers being included at the interface between the two portions of the travel path. Suitable telemetry systems include the mud pulse telemetry systems described above, which may be used for uplinks and/or downlinks.

Acoustic telemetry may be employed for uplinks and/or downlinks. For example, piezo or other devices may be coupled to drill string 808 at or near one encl to create acoustic signals that travel along drill string 808, and other piezo or other devices may be coupled to drill string 808 at or near the opposite end of drill string 808 to receive the acoustic signals. Repeaters may be employed along drill string 808 to receive and re-launch the acoustic signals.

Electromagnetic (EM) telemetry may be employed for uplinks and/or downlinks. EM telemetry systems may utilize a relatively low frequency (e.g., 1 to 100 Hz) signal created using an antenna subsystem with an insulative gap in the BHA to communicate an electromagnetic signal from a location downhole to the surface. Drill string 108 and its casing may serve as one conductor and the formation may serve as the other conductor. The EM signal may be sensed at the surface by measuring voltage and/or current between the drill string casing or other connected conductive elements at the surface and an electrode coupled to the formation. An EM signal may be communicated from the surface to downlink by applying a low frequency signal between the two surface contact points, and may be sensed downhole by measuring voltage and/or current across the insulative gap of the antenna sub.

Uplinks and downlinks may be provided by a wire conveyed between the surface and one or more downhole components. Suitable implementations of this approach include running a wireline down the center of or along the outside of drill string 808. A wired pipe approach may utilize wire that is integral with the drill pipe and inductive couplings between sections of drill pipe. This wired pipe approach may be used for uplinks and/or downlinks.

PDC 855 may determine whether or when modifications should be made to the operating parameters of a PPD operation and may initiate adjustments that directly or indirectly affect any operating parameters that are to be modified without the need for those components to be removed from wellbore 816. For example, PDC 855 may initiate real-time adjustments of PPD system 800 in response to changing conditions during a drilling operation. By making real-time adjustments, the number of times that all or a portion of drill string 808 is removed from wellbore 816 may be reduced and the ROP achieved during PPD operations may be improved.

PDC 855 may be coupled to, or otherwise in communication with, SAS 850. Alternatively, the functionality of SAS 850 may be integrated within PDC 855, with PDC 855 acting as a master controller for PPD operations. Signal or informational inputs to PDC 855 may include measurements received from both downhole and surface sensors, or results of calculations made based on those measurements, indicating ROP, characteristics of cuttings, characteristics of drilling fluid 822 returning from downhole to the surface and/or entrained gas; downhole measurements of hole caliper or quality, vibration, or other wellbore characteristics; formation measurements; fluid pressure measurements; wellbore direction measurements; wellbore tortuosity or dogleg severity; and measurements of parameters within the pulsed-power tool itself, such as power draw, voltages, currents, frequencies, or wave forms measured within the tool at various sensing points, some of which may be associated with one or more particular electronic components.

The downhole operating environment is typically a high temperature environment, and the temperature may affect the performance, survival, and required maintenance cycles of the various electronic and other components of a pulsed-power tool. In addition, the operation of these components for pulsed power drilling may generate heat and may further raise the temperature of the environment and the components themselves. The temperature of a pulsed-power tool may be measured at one or more locations. Temperature measurements for a pulsed-power tool may be obtained using temperature sensors coupled to or proximate to particular electronic components of the pulsed-power tool. These temperature measurements may be useful for controlling operations in accordance with operating and/or survival specifications and intended operating points, for calculating component efficiency and/or for detecting incipient failure.

Inputs to PDC 855 may include modeled or otherwise calculated targets for one or more operating parameters of a PPD operation. Inputs to PDC 855 may include user specified target values for one or more operating parameters of a PPD operation.

Operating parameters of a PPD operation may be modified by adjusting one or more components. The adjustments may be made using electrical components, such as by activating or deactivating solid state switches, using electromechanical components, e.g., by controlling relays, or using purely mechanical components, such as by mechanically toggling a device from one state to a second or subsequent state.

Figure 9A:
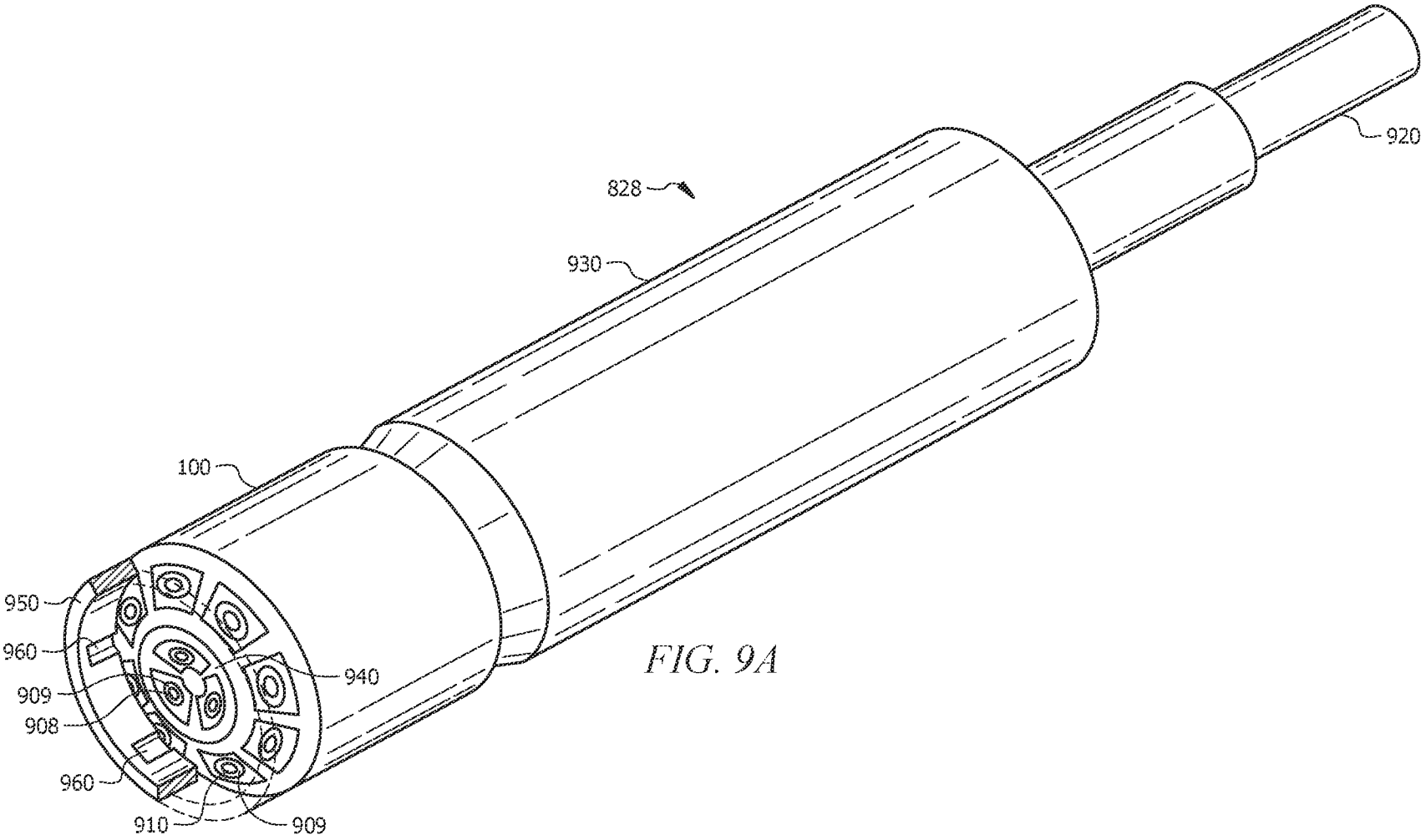
FIG. 9A is a perspective view of example components of a bottom-hole assembly (BHA) for a PPD system, according to embodiments of this disclosure.

FIG. 9A is a perspective view of exemplary components of a bottom-hole assembly for a PPD system, such as PPD system 800 of FIG. 8. BHA 828 may include pulsed-power tool 930 and drill bit 100. For the purposes of the present disclosure, drill bit 100 may be integrated within BHA 828, or may be a separate component coupled to BHA 828.

Pulsed-power tool 930 may provide pulsed electrical energy to drill bit 100. Pulsed-power tool 930 receives electrical power from a power source via cable 920. For example, pulsed-power tool 930 may receive electrical power via cable 920 from a power source located on the surface as described above with reference to FIG. 8, or from a power source located downhole such as a generator powered by a mud turbine. Pulsed-power tool 930 may also receive electrical power via a combination of a power source located on the surface and a power source located downhole. Drill bit 100 may include a ground ring, such as ground ring 200 of FIG. 2, and an electrode section having one or more electrodes, such as electrode section 300 of FIG. 3. In the embodiment of FIG. 9A, drill bit 100 comprises one or more electrodes 908 and 910 in electrode section 940, and a ground ring 950, shown in part in FIG. 9A. Electrode section 940 and/or ground ring 950 can comprise the functional gradient of material described hereinabove with reference to FIGS. 2A-4B, from a first portion to a second portion thereof, wherein the functional gradient of material provides a greater wear resistance of the first portion relative to the second portion and a greater electrical conductivity or resistivity of the second portion relative to the first portion.

Ground ring 950 may function as an electrode. Pulsed-power tool 930 converts electrical power received from the power source into pulse drilling signals in the form of high-energy electrical pulses that are applied across electrodes 908 and/or 910 and ground ring 950 of drill bit 100. Pulsed power tool 930 may include a PG circuit as described above with reference to FIG. 8.

Although illustrated as a contiguous ring in FIG. 9A, ground ring 950 and/or electrode section 940 can be non-contiguous and include discrete electrodes and/or can be implemented in different shapes. Each of electrodes 908 and 910 may be positioned at a minimum distance from ground ring 950 of approximately 0.4 inches and at a maximum distance from ground ring 950 of approximately 6 inches. The distance between electrodes 908 or 910 and ground ring 950 may be based on the parameters of the PPD operation and/or on the diameter of drill bit 100. For example, the distance between electrodes 908 or 910 and ground ring 950, at their closest spacing, may be at least 0.4 inches, at least 1 inch, at least 1.5 inches, or at least 2 inches.

Referring to FIG. 8 and FIG. 9A, drilling fluid 822 can be circulated through PPD system 800 at a flow rate sufficient to remove fractured rock from the vicinity of drill bit 100. In addition, drilling fluid 822 may be under sufficient pressure at a location in wellbore 816, particularly a location near a hydrocarbon, gas, water, or other deposit, to prevent a blowout. Drilling fluid 822 may exit drill string 808 via openings 909 (or ports 350 of electrode section 300 of FIG. 3) surrounding each of electrodes 908 and 910. The flow of drilling fluid 822 out of openings 909 can allow electrodes 908 and 910 to be insulated by the drilling fluid. A solid insulator (not expressly shown) may surround electrodes 908 and 910 on drill bit 100. Drill bit 100 may also include one or more fluid flow ports 960 on the face of drill bit 100 through which drilling fluid 822 exits drill string 808, for example fluid flow ports 960 on ground ring 950 (or flow ports 250 on a ground ring 200 of FIG. 2). Fluid flow ports 960 may be simple holes, or they may be nozzles or other shaped features. Because fines are not typically generated during pulsed-power drilling, as opposed to mechanical drilling, drilling fluid 822 might not need to exit the drill bit with as high a pressure drop as the drilling fluid in mechanical drilling. As a result, nozzles and other features used to increase drilling fluid pressure drop and associated fluid velocity may not be needed on drill bit 100. However, nozzles or other features to increase the velocity of drilling fluid 822 or to direct drilling fluid may be included for some uses. Additionally, the shape of a solid insulator, if present, may be selected to enhance the flow of drilling fluid 822 around the components of drill bit 100.

If PPD system 800 experiences vaporization bubbles in drilling fluid 822 near drill bit 100, the vaporization bubbles may have deleterious effects. For instance, vaporization bubbles near electrodes 908 or 910 may impede formation of the arc in the rock. Drilling fluid 822 may be circulated at a flow rate also sufficient to remove vaporization bubbles from the vicinity of drill bit 100 Fluid flow ports 960 may permit the flow of drilling fluid 822 along with any fractured rock or vaporization bubbles away from electrodes 908 and 910 and uphole.

Figure 9B:
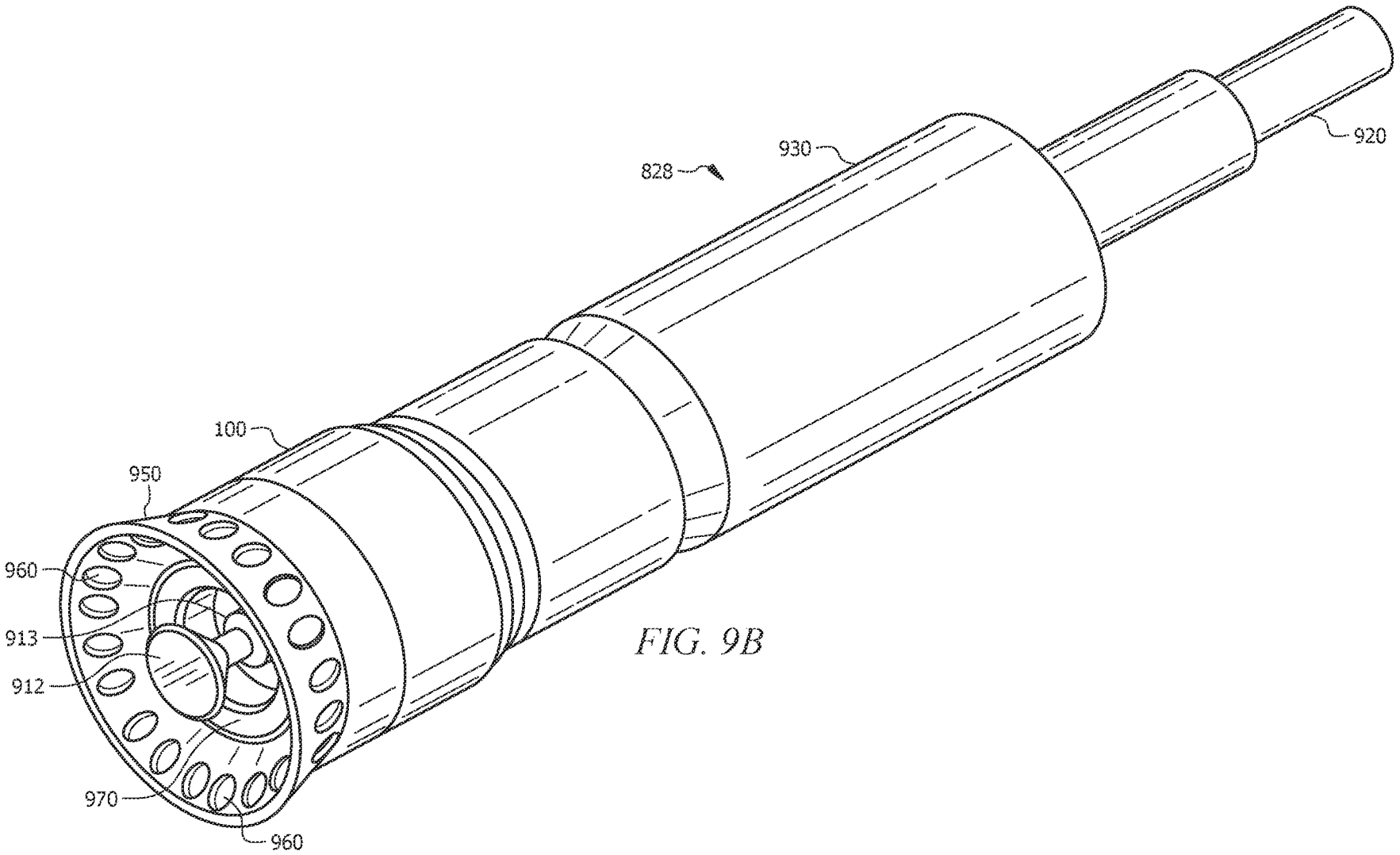
FIG. 9B is a perspective view of example components of a bottom-hole assembly (BHA) for a PPD system, according to embodiments of this disclosure.

FIG. 9B is a perspective view of exemplary components of another bottom-hole assembly for a PPD system. BHA 828 may include pulsed-power tool 930 and drill bit 100. For the purposes of the present disclosure, drill bit 100 may be integrated within BHA 828, or may be a separate component that is coupled to BHA 828. BHA 828 and pulsed-power tool 930 may include features and functionalities similar to those discussed above with reference to FIG. 9A.

Drill bit 100 may include bit body 855, electrode 912 (or an electrode section 300 as depicted in FIG. 3), ground ring 950 (or a ground ring 200 as depicted in FIG. 2), and solid insulator 970. Electrode 912 and/or ground ring 950 can comprise the functional gradient of material described hereinabove with reference to FIGS. 2A-4B, from a first portion to a second portion thereof, wherein the functional gradient of material provides a greater wear resistance of the first portion relative to the second portion and a greater electrical conductivity or resistivity of the second portion relative to the first portion. Electrode 912 may be placed approximately in the center of drill bit 100. Electrode 912 may be positioned at a minimum distance from ground ring 950 of approximately 0.4 inches and at a maximum distance from ground ring 950 of approximately 6 inches. The distance between electrode 912 and ground ring 950 may be based on the parameters of the PPD operation and/or on the diameter of drill bit 100. For example, the distance between electrode 912 and ground ring 950, at their closest spacing, may be at least 0.4 inches, at least 1 inch, at least 1.5 inches, or at least 2 inches. The distance between electrode 912 and ground ring 950 may be generally symmetrical or may be asymmetrical such that the electric field surrounding the drill bit has a symmetrical or asymmetrical shape. The distance between electrode 912 and ground ring 950 allows drilling fluid 822 to flow between electrode 912 and ground ring 950 to remove vaporization bubbles from the drilling area. Electrode 912 may have any suitable diameter based on the PPD operation, the distance between electrode 912 and ground ring 950, and/or the diameter of drill bit 100. For example, electrode 912 may have a diameter between approximately 2 and approximately 10 inches. Ground ring 950 may function as an electrode and provide a location on the drill bit where an electrical arc may initiate and/or terminate.

Drill bit 100 may include one or more fluid flow ports on the face of the drill bit through which drilling fluid exits the drill string 808. For example, ground ring 950 of drill bit 100 may include one or more fluid flow ports 960 (or ports 250 of ground ring 200 of FIG. 2) such that drilling fluid 822 flows through fluid flow ports 960 carrying fractured rock and vaporization bubbles away from the drilling area. Fluid flow ports 960 may be simple holes, or they may be nozzles or other shaped features. Drilling fluid 822 is typically circulated through PPD system 800 at a flow rate sufficient to remove fractured rock from the vicinity of drill bit 100. In addition, drilling fluid 822 may be under sufficient pressure at a location in wellbore 816, particularly a location near a hydrocarbon, gas, water, or other deposit, to prevent a blowout. Drilling fluid 822 may exit drill string 808 via opening 913 surrounding electrode 912. The flow of drilling fluid 822 out of opening 913 allows electrode 912 to be insulated by the drilling fluid. Because fines are not typically generated during pulsed-power drilling, as opposed to mechanical drilling, drilling fluid 822 might not need to exit the drill bit with as high a pressure drop as is typical for the drilling fluid in mechanical drilling. As a result, nozzles and other features used to increase drilling fluid velocity may not be needed on drill bit 100. However, nozzles or other features to increase the velocity of drilling fluid 822 or to direct drilling fluid 822 may be included for some uses. Additionally, the shape of solid insulator 970 may be selected to enhance the flow of drilling fluid 822 around the components of drill bit 100.

As described above with reference to FIGS. 8, 9A, and 9B, when the electric potential across electrodes of a pulsed-power drill bit becomes sufficiently large, an electrical arc forms through the rock formation and/or drilling fluid that is near the electrodes. The arc provides a temporary electrical short between the electrodes, and thus allows electric current to flow through the arc inside a portion of the rock formation and/or drilling fluid at the distal end of the wellbore. The arc increases the temperature of the portion of the rock formation through which the arc flows and the surrounding formation and materials. The temperature is sufficiently high to vaporize any water or other fluids that might be proximate to the arc and may also vaporize part of the rock. The vaporization process creates a high-pressure gas and/or plasma which expands and, in turn, fractures the surrounding rock.

PPD systems and pulsed-power tools may utilize any suitable PG circuit topology to generate and apply high-energy electrical pulses across electrodes within the pulsed-power drill bit. Such PG circuit topologies may utilize electrical resonance to generate the high-energy electrical pulses required for pulsed-power drilling. The PG circuit may be shaped and sized to fit within the circular cross-section of pulsed-power tool 930, which as described above with reference to FIGS. 9A and 9B, may form part of BHA 828. The PG circuit and its electronic components may be enclosed within an encapsulant, which may help maintain mechanical stability under shock and vibration. The encapsulant may be made of a thermally conductive material that helps transfer heat away from the PG circuit and its electronic components to protect the PG circuit and other components from damage due to the combination of self-generated heat and the heat of the ambient downhole environment. The downhole environment may include a wide range of temperatures. For example, the temperature within the wellbore may range from approximately 10 to approximately 300 degrees Centigrade.

The PPD systems described herein may generate multiple electrical arcs per second using a specified excitation current profile that causes a transient electrical arc to form an arc through the most conducting portion of the well bore floor. The arc causes that portion of the distal end of the wellbore to disintegrate or fragment and be swept away by the flow of drilling fluid. As the most conductive portions of the wellbore floor are removed, subsequent electrical arcs may naturally seek the next most conductive portion.

The electrical pulses used for electro-crushing drilling may be generated using any of a variety of PG circuits including, but not limited to, circuits that include capacitive energy storage elements and circuits that include inductive energy storage elements.

Design and material property optimization via a binder jetting process can be utilized, as detailed herein, to provide high wear resistant and low electrical resistivity materials for PPD component(s) for electromagnetic pulsed drilling.

Via this disclosure, binder jetting additive manufacturing can be utilized for WC with a complex binder system to provide a combination of both mechanical and electrical wear resistance of PPD component(s). Functional grading within the PPD component geometry can provide further improvement in wear and electrical conductivity.

The additive manufacturing technique of binder jetting can be employed to optimize material chemistry and PPD component design, as described herein. In binder jetting process 500 the PPD component 600 can be additively manufactured using a powder 725 based process layer by layer with the help of a binder 735 (also known as a glue) in the green state 730. In embodiments, process 500 can allow for the ability to optimize the structure and composition of the PPD component 600 into a near-net shape structure (such as lattice structure, blind hole, graded structure). The post additive sintering can aid in the sintering of the liquid phase (binder 735) to form the PPD component 600.

In embodiments, the use of WC as the first material 615 and/or the second material 615 can provide mechanical wear (impact, abrasion, erosion); the binder (e.g., first binder composition 616, second binder composition 626) used in additive manufacturing of the PPD component(s) 600 (e.g., ground ring 200, electrode portion 300) can help reduce the electric wear in portions of the PPD component exposed to excess electricity and the wear in portions of the PPD component exposed to more wear; shapes needed for the PPD component(s) can be easily created via the additive manufacturing (e.g., binder jetting) system 700 and method 500; electrical resistance can be reduced, while wear resistance can be maximized on the other end (or second portion 240/340) of the PPD component via the functional gradient of material 270/370/470; the disclosed binder jetting system 700 and method 500 enable additional light-weighting by optional incorporation of lattice structure and/or blind holes.

PPD components (e.g., ground rings 200, electrode portions 300, other PPD components 600) produced as described herein may be provided with lower cost, better reliability and longer life.

Conventional material families include cemented WC with cobalt binder, which are good for wear, but with conventional press and sinter manufacture, can't provide the level of complexity required in manufacturing PPD components; WC—Cu—Ni—X systems, which cemented carbides having copper based matrices are primarily made using infiltration process, similar to what is deployed in the fixed cutter drill bits, and are difficult to manufacture into the PPD component shapes having the herein described functional gradient 270/370/470); and cobalt based Co—Cr—W satellite alloys, which are reasonably wear resistant in both their cast as well as wrought form, but lack the desirable electrical properties and have erosion properties that are inferior to WC based systems and thus may not be adequate for PPD components. The material or the process (cast, wrought, infiltration) can be a limitation in creation of PPD components. Utilization of binder jetting additive manufacturing allows the creation of PPD component(s) 600 having the desired shapes and functional gradient of desirable materials, as described hereinabove.

The PPD components 600 (e.g., ground ring 200, electrode section 300) described hereinabove can exhibit a level of complexity enabled via production thereof using a binder jetting additive process, rather than other processes, such as infiltration. Binder jetting additive manufacturing allows for intricate designs as well as material composition variations (e.g., from the first portion 230/330 to the second portion 240/340).

In embodiments, provided herein are PPD components that are created via binder jetting to include functionally graded cermets that are complex in geometry while providing an optimal combination of wear resistance, corrosion resistance and toughness.

Other advantages will be apparent to those of skill in the art and with the help of this disclosure.

EXAMPLES

The embodiments having been generally described, the following examples are given as particular embodiments of the disclosure and to demonstrate the practice and advantages thereof. It is understood that the examples are given by way of illustration and not intended to limit the specification or the claims in any manner.

Example 1

In this Example 1, three material families were subjected to electrical pulse testing. The first family includes a relatively higher wear resistant grade from the Stellite family (Stellite 720). The second family included WC—Co—X in a binder jet process. The third family included a WC—Cu based material in the bar for using the process of infiltration.

A surface scan of the electrical wear scar of the Stellite 720 showed deep scar damage. Accordingly, the Stellite 720 was not suitable for PPD. The WC—Co—X formed with the binder jetting process showed much improved response to the 150 kV electric pulse, when the surface scans of the three families were compared. The WC—Cu based material in the bar for using the process of infiltration showed very similar results as WC—Co—X using binder jetting. However, the binder jetting process provides significantly enhanced flexibility in composition property gradation optimization that can be utilized as described herein to enhance the wear and conducting properties of various portions of the PPD component.

ADDITIONAL DISCLOSURE

The following are non-limiting, specific embodiments in accordance with the present disclosure:

In a first embodiment, a pulsed power drilling (PPD) component comprises: a functional gradient of material from a first portion to a second portion of the PPD component, wherein the functional gradient of material provides a greater wear resistance of the first portion relative to the second portion and a greater electrical conductivity or resistivity of the second portion relative to the first portion.

A second embodiment can include the PPD component of the first embodiment, wherein the functional gradient of material is produced by binder jetting the first portion and the second portion of the PPD component.

A third embodiment can include the PPD component of the first or second embodiment, wherein the PPD component comprises a ground ring, or an electrode section of a PPD electrode assembly.

A fourth embodiment can include the PPD component of any one of the first to third embodiments, wherein the first portion comprises flow ports.

A fifth embodiment can include the PPD component of the fourth embodiment, wherein the second portion is at an opposite end of the PPD component from the first portion.

A sixth embodiment can include the PPD component of any one of the first to fifth embodiments, wherein the material comprises tungsten carbide and a binder selected from copper (Cu), cobalt (Co), nickel (Ni), or a combination thereof, and where the gradient of material is provided by a first composition of the binder in the first portion that is different from a second composition of the binder in the second portion.

A seventh embodiment can include the PPD component of the sixth embodiment, wherein the first composition of the binder comprises more cobalt (Co) than the second composition of the binder.

An eighth embodiment can include the PPD component of the seventh embodiment, wherein the second composition of the binder comprises more copper, nickel, or both than the first composition of the binder.

A ninth embodiment can include the PPD component of any one of the sixth to eighth embodiments, wherein the first composition of the binder comprises cobalt (Co), and the second composition of the binder comprises nickel (Ni).

A tenth embodiment can include the PPD component of the ninth embodiment, wherein the first composition of the binder comprises cobalt (Co) and copper (Cu), wherein from about 52 to about 99 weight percent (wt %) of the first composition of the binder comprises cobalt (Co).

An eleventh embodiment can include the PPD component of any one of the ninth or tenth embodiments, wherein the second composition of the binder comprises cobalt (Co) and copper (Cu), and wherein from about 52 to about 99 weight percent (wt %) of the second composition of the binder comprises copper (Cu).

A twelfth embodiment can include the PPD component of any one of the ninth to eleventh embodiments, wherein the binder comprises copper (Cu), nickel (Ni), and cobalt (Co).

A thirteenth embodiment can include the PPD component of the twelfth embodiment, wherein the first binder composition comprises from about 90 to 99 weight percent (wt %) Cu, less than 3 wt % Co, and the balance Ni.

A fourteenth embodiment can include the PPD component of any one of the first to thirteenth embodiments, wherein the PPD component is configured to carry voltages in a range of from about 100,000 to 150,000 volts (V) during operation of a PPD electrode assembly comprising the PPD component.

In a fifteenth embodiment, a method of making a pulsed power drilling component comprises: forming a functional gradient in material from a first portion of the PPD component to a second portion of the PPD component by binder jetting the first portion with layers of a first material bound with a first binder composition and binder jetting the second portion with layers of a second material bound with a second binder composition, whereby the functional gradient of material provides the first portion with a greater wear resistance than the second portion and the second portion with a greater electrical conductivity or resistivity than the first portion.

A sixteenth embodiment can include the method of the fifteenth embodiment, wherein the functional gradient of material is continuous or stepwise from the first portion to the second portion.

A seventeenth embodiment can include the method of the fifteenth or sixteenth embodiment, wherein the functional gradient is continuous from a first end of the PPD component to a second end of the PPD component, wherein the first portion comprises the first end of the PPD component and the second portion comprises the second end of the PPD component.

An eighteenth embodiment can include the method of any one of the fifteenth to seventeenth embodiments, wherein the first material and the second material comprise tungsten carbide (WC).

A nineteenth embodiment can include the method of any one of the fifteenth to eighteenth embodiments, wherein the first binder composition comprises cobalt (Co), and wherein an amount of Co in the first binder composition is greater than an amount of Co in the second binder composition.

A twentieth embodiment can include the method of the nineteenth embodiment, wherein the second binder composition comprises copper (Cu), nickel (Ni), or both Cu and Ni, and wherein an amount of Cu, an amount of Ni, or both an amount of Cu and an amount of Ni in the second binder composition is greater than an amount of Cu, an amount of Ni, or an amount of Cu and an amount of Ni, respectively, in the first binder composition.

A twenty first embodiment can include the method of the nineteenth or twentieth embodiment, wherein the first binder composition comprises cobalt (Co) and copper (Cu), and comprises from about 52 to 99 weight percent (wt %) Co.

A twenty second embodiment can include the method of the twenty first embodiment, wherein the second binder composition comprises Co and Cu, and wherein the second binder composition comprises from about 52 to about 99 weight percent (wt %) Cu.

A twenty third embodiment can include the method of any one of the fifteenth to twenty second embodiments, wherein the first binder composition comprises or consists essentially of cobalt (Co) and the second binder composition comprises or consists essentially of nickel (Ni).

A twenty fourth embodiment can include the method of any one of the fifteenth to twenty third embodiments, wherein the first binder composition, the second binder composition, or both the first binder composition and the second binder composition comprise cobalt (Co), copper (Cu), and nickel (Ni).

In a twenty fifth embodiment, a pulsed power drilling (PPD) component comprises a PPD component produced by the method of any one of the fifteenth to twenty fourth embodiments.

A twenty sixth embodiment can include the PPD component of the twenty fifth embodiment, wherein the PPD component is an electrode section or a ground ring of a PPD electrode assembly.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A pulsed power drilling (PPD) component comprising:

a functional gradient of a material from a first portion to a second portion of the PPD component, wherein the functional gradient of the material provides a greater wear resistance of the first portion relative to the second portion and a greater electrical conductivity or resistivity of the second portion relative to the first portion, and wherein the material comprises tungsten carbide and a binder selected from copper (Cu), cobalt (Co), nickel (Ni), or a combination thereof, where the gradient of material is provided by a first composition of the binder in the material of the first portion that is different from a second composition of the binder in the material of the second portion.

2. The PPD component of claim 1, wherein the functional gradient of material is produced by binder jetting the first portion and the second portion of the PPD component.

3. The PPD component of claim 1, wherein the PPD component comprises a ground ring of a PPD electrode assembly.

4. The PPD component of claim 1, wherein the first portion comprises flow ports.

5. The PPD component of claim 4, wherein the second portion is at an opposite end of the PPD component from the first portion.

6. The PPD component of claim 1, wherein the first composition of the binder comprises more cobalt (Co) than the second composition of the binder.

7. The PPD component of claim 6, wherein the second composition of the binder comprises more copper, nickel, or both than the first composition of the binder.

8. The PPD component of claim 1, wherein the first composition of the binder comprises cobalt (Co), and the second composition of the binder comprises nickel (Ni).

9. The PPD component of claim 1, wherein the PPD component comprises an electrode section of a PPD electrode assembly.

10. The PPD component of claim 1, wherein the functional gradient is substantially continuous from a first end of the PPD component to a second end of the PPD component, wherein the first portion comprises the first end of the PPD component and the second portion comprises the second end of the PPD component.

11. A method of making a pulsed power drilling component, the method comprising:

forming a functional gradient in a material from a first portion of the PPD component to a second portion of the PPD component by binder jetting the first portion with layers of the material bound with a first binder composition and binder jetting the second portion with layers of the material bound with a second binder composition, whereby the functional gradient of the material provides the first portion with a greater wear resistance than the second portion and the second portion with a greater electrical conductivity or resistivity than the first portion.

12. The method of claim 11, wherein the functional gradient of material is continuous or stepwise from the first portion to the second portion.

13. The method of claim 11, wherein the functional gradient is continuous from a first end of the PPD component to a second end of the PPD component, wherein the first portion comprises the first end of the PPD component and the second portion comprises the second end of the PPD component.

14. The method of claim 11, wherein the first material comprises tungsten carbide (WC).

15. The method of claim 11, wherein the first binder composition comprises cobalt (Co), and wherein an amount of Co in the first binder composition is greater than an amount of Co in the second binder composition.

16. The method of claim 15, wherein the second binder composition comprises copper (Cu), nickel (Ni), or both Cu and Ni, and wherein an amount of Cu, an amount of Ni, or both an amount of Cu and an amount of Ni in the second binder composition is greater than an amount of Cu, an amount of Ni, or an amount of Cu and an amount of Ni, respectively, in the first binder composition.

17. The method of claim 15, wherein the first binder composition comprises cobalt (Co) and copper (Cu), and comprises from about 52 to 99 weight percent (wt %) Co.

18. The method of claim 17, wherein the second binder composition comprises Co and Cu, and wherein the second binder composition comprises from about 52 to about 99 weight percent (wt %) Cu.

19. The method of claim 11, wherein the first binder composition comprises or consists essentially of cobalt (Co) and the second binder composition comprises or consists essentially of nickel (Ni).

20. A pulsed power drilling (PPD) component produced by a method comprising forming a functional gradient in a material from a first portion of the PPD component to a second portion of the PPD component by binder jetting the first portion with layers of the material bound with a first binder composition and binder jetting the second portion with layers of the material bound with a second binder composition, whereby the functional gradient of the material provides the first portion with a greater wear resistance than the second portion and the second portion with a greater electrical conductivity or resistivity than the first portion.

21. The PPD component of claim 20, wherein the PPD component is an electrode section or a ground ring of a PPD electrode assembly.

* * * * *